US010336943B2

(12) United States Patent
Valdevies

(10) Patent No.: US 10,336,943 B2
(45) Date of Patent: Jul. 2, 2019

(54) METHOD FOR COKE OVEN REPAIR

(71) Applicants: PAUL WURTH DO BRASIL TECNOLOGIA E SOLUCOES INDUSTRIAIS LTDA, Belo Horizonte, M.G. (BR); Francesco Valdevies, Cursi Lecce (IT)

(72) Inventor: Francesco Valdevies, Cursi Lecce (IT)

(73) Assignees: PAUL WURTH DO BRASIL TECNOLOGIA E SOLUCOES INDUSTRIAIS LTDA, Belo Horizonte, M.G. (BR); Francesco Valdevies, Cursi Lecce (IT)

( * ) Notice: Subject to any disclaimer, the term of this patent is extended or adjusted under 35 U.S.C. 154(b) by 155 days.

(21) Appl. No.: 15/583,763

(22) Filed: May 1, 2017

(65) Prior Publication Data

US 2017/0313943 A1 Nov. 2, 2017

(30) Foreign Application Priority Data

Apr. 29, 2016 (BR) ..... 102016009636

(51) Int. Cl.
*C10B 29/06* (2006.01)

(52) U.S. Cl.
CPC ..... *C10B 29/06* (2013.01)

(58) Field of Classification Search
CPC ..... C10B 29/02; F27D 1/1621; F27D 1/04; F27D 1/1626
See application file for complete search history.

(56) References Cited

U.S. PATENT DOCUMENTS 4,545,860 A * 10/1985 Lyskawa ..... C10B 29/06 201/41

FOREIGN PATENT DOCUMENTS

| | | | | |
|---|---|---|---|---|
| JP | 06041541 A | * | 2/1994 | |
| JP | 2000002491 A | * | 1/2000 | |
| JP | 2008169315 A | * | 7/2008 | |
| NL | 9300558 A | * | 10/1994 | ..... C10B 29/06 |

OTHER PUBLICATIONS

English translation of JP2000002491 (Year: 2000).*
English translation of JP06041541 (Year: 1994).*
English translation of JP2008169315 (Year: 2008).*

* cited by examiner

*Primary Examiner* — Jun S Yoo
(74) *Attorney, Agent, or Firm* — Cantor Colburn LLP

(57) ABSTRACT

The ovens (F) are arranged side by side in a battery and are each delimited by two sidewalls (10) formed by side bricks (11) and joined by transverse bricks (12, 13). The method comprises: cutting each sidewall (10) to be repaired in accordance with a cutting plane (PC) defining a respective end flat face (14) in the middle portion of the wall (10*a*) to be maintained and coinciding with the face of a row of transverse bricks (12, 13) facing an adjacent end wall portion (10*b*) which is being removed; providing in each flat end face (14), a pair of cutouts (15), each having in a basic transverse face, a longitudinal middle channel (15*c*) in which a tongue (11*c*) of new bricks from a new end wall portion (10*b*) is fitted; fitting in each cutout (15) a corresponding portion of a vertical row of side bricks (11*a*, 11*b*) for the new end wall portion (10*b*) until the formation is complete.

9 Claims, 7 Drawing Sheets

METHOD FOR COKE OVEN REPAIR

CROSS REFERENCE TO RELATED APPLICATION

This application is related to and claims the benefit of and priority to Brazil Application Number 10 2016 009636 7 filed on 29 Apr. 2016, the contents of which are herein incorporated by reference in their entirety.

TECHNICAL FIELD

The present invention relates to a method for the partial or complete hot-repair of the refractory walls that define the sides of each individual oven of a battery of coke ovens, each sidewall being built as hollow sections in order to define the heating or combustion chambers.

BACKGROUND OF THE INVENTION

Coke oven batteries defined by a set of ovens, typically 25-100 ovens, built side by side, delimited by opposing sidewalls made of refractory bricks and being built as hollow sections to define, internally, the renowned heating or combustion chambers are well known in the art.

The opposing sidewalls are seated on a generally concrete base and are closed on the upper part by a top wall which is also made of refractory material, each oven being closed by a ceiling (roof), also made of refractory material and provided with loading ports to enable the loading of coal, which after a 16-36 hour cycle, is transformed into coke due to the heating process which they are subjected to within each oven (FIGS. 1, 2 and 3).

Each hollow sidewall has its heating chambers arranged in vertical columns sequentially laid along the length of each internal wall and provided underneath with at least one ceramic burner, which depending on the number of combustion flues, are arranged along the length of said opposite sidewalls, generally every 500 mm, and it should be noted that the dimensions of each oven of the battery may range from about 400 mm to 700 mm in width and from about 3500 mm to 7500 mm in height and moreover a length of about 13000 mm, and with each two adjacent ovens sharing a common sidewall.

The opposite sidewalls of each oven are those that define the left and right sides of the respective oven, over the entire height of the latter. These sidewalls are made of refractory bricks, usually made of silica, forming the so called "rows". The roof of the ovens and the top of the combustion flues in each sidewall are always built with bricks arranged in "rows" and made of silica, fireclay, clinker or insulating material (FIGS. 1, 2 and 3).

It turns out that the coke ovens described above have progressive wear of their opposing sidewalls, and this wear is more pronounced on the anterior and posterior end regions of said walls. Thus, in many cases there is no need to entirely replace one or more of these coke ovens sidewalls. It is enough to simply replace the opposite end portions of said walls.

Often, the damaged end portions, which actually require repair by being replaced by new portions, represent altogether only about 30% to 40% of the total extent of a sidewall. Thus, replacing only the damaged or worn end portions of the sidewalls represents considerable savings in the repair operations of coke oven batteries.

While only partial replacement of the worn sidewalls is desirable, techniques that have been applied for the partial replacement of the sidewalls require laborious and expensive procedures to obtain an adequate joint between the 'new refractory bricks' and 'old refractory bricks', keeping the reformed walls with characteristics such as the resistance to the expansion of coal, the absence of gas leakage, elasticity between the new end portion and the old middle portion of each renovated wall.

In conventional techniques, the removal of the worn end portions of each wall is obtained by performing a flat vertical cutting operation in each of the regions bordering the middle portion of the wall to be maintained. The provision of these two cuts in the bordering regions defines the two flat and opposite end faces, arranged in orthogonal planes to their wall plane and against these walls there must be settled and fixed, watertight and with the necessary mechanical locking, the confronting flat faces of the adjacent bricks in the first row of the new refractory bricks that will form the two end portions to be mounted and solidly built in the middle portion of the old wall.

Due to the formation of flat joints between the new end portions and the middle portion of the old wall, the fixing of the flat faces of the old bricks on the flat faces of the new refractory bricks requires not only the necessary seal to resist the operating conditions of the oven, but also the mechanical forces of outwardly expansion of said sidewalls, during operation of the oven, by virtue of the expansion of the coal charge being converted into coke.

In this method for the partial repair of the coke oven walls, the strength of the junction regions, against forces transversal to the wall plane, requires the provision of ceramic welding between the old bricks and the new bricks by means of costly and laborious ceramic welds over the entire height of the junction region, which generally corresponds to the entire height of the sidewall of the oven.

In a battery composed of one hundred ovens, each of which may have up to about 7000 mm in height, each hollow wall may have four junction regions, two at each end, to be completed with the use of respective ceramic welds, which makes this operation extremely time-consuming and expensive due to the characteristics of such a ceramic welding process.

Besides the above-identified deficiencies derived from the requirement for the provision of a ceramic weld in the flat junction between the new and old bricks, this well-known method also requires maintenance and even the periodic replacement of these ceramic weld joints every two or three years, involving huge expenses for the maintenance of these ovens in suitable operating conditions.

Another drawback of the known methods is to restrict the number of adjacent walls to be partially or completely repaired, depending on the maximum allowable span for the maintenance of the travel rails of the loading machine which moves above the furnace battery. Typically, the number of adjacent walls to be reformed simultaneously cannot exceed five, thus limiting the number of walls to be simultaneously repaired or replaced.

SUMMARY OF THE INVENTION

Due to the drawbacks and limitations of the existing methods for repairing the sidewalls of coke ovens, it is an object of the present invention to provide a method for repairing the refractory walls of said ovens, enabling the rapid and relatively simple replacement of the sidewall end portions of said ovens with safe and tight mechanical connection between the new wall portions and the old wall portions without requiring ceramic welds in junction zones.

An additional object of the present invention is to allow partial and/or complete (mixed) repair of a larger number of sidewalls of adjacent ovens simultaneously without impairing the operation of the loading machine above the ovens of the coke oven battery which remain in operation.

As already mentioned, the method of the present invention is applied in the repair of coke ovens arranged side by side in a battery and which are each delimited by two hollow sidewalls, each one formed by side bricks, superimposed in two opposite rows, spaced and joined by transverse bricks and defining heating chambers there between.

According to the invention, the method comprises the initial steps of selecting adjacent sidewalls that have a middle wall portion to be maintained during the repair, and two end wall portions to be replaced by new end wall portions.

Then, each sidewall to be repaired is cut according to a cross-sectional vertical plane in order to define a respective flat end face on the middle wall portion, this cutting plane (PC) being coincident with a face of a row of transverse bricks, facing the adjacent end wall portion that is removed.

In each flat end face of the middle wall portion, a pair of lateral and opposite cutouts are provided and extended over the entire height of the sidewall, and a medial longitudinal groove defining a groove for a corresponding rib of the new bricks, larger side and standard side of the new end wall portion.

In each groove of a flat end face, a corresponding portion of a vertical row of side bricks of an adjacent new end wall portion is engaged.

The new end wall portion has its formation completed by the use of new transverse bricks with the same standard construction as the transverse bricks in the sidewall being restored.

The procedure above is fast and ensures a solid mechanical connection between the old and new portions of the wall being repaired without requiring any ceramic welding.

BRIEF DESCRIPTION OF THE DRAWINGS

The invention will now be described with reference to the accompanying drawings, given by way of example, in which.

DESCRIPTION OF PREFERRED EMBODIMENTS

Figure 1:
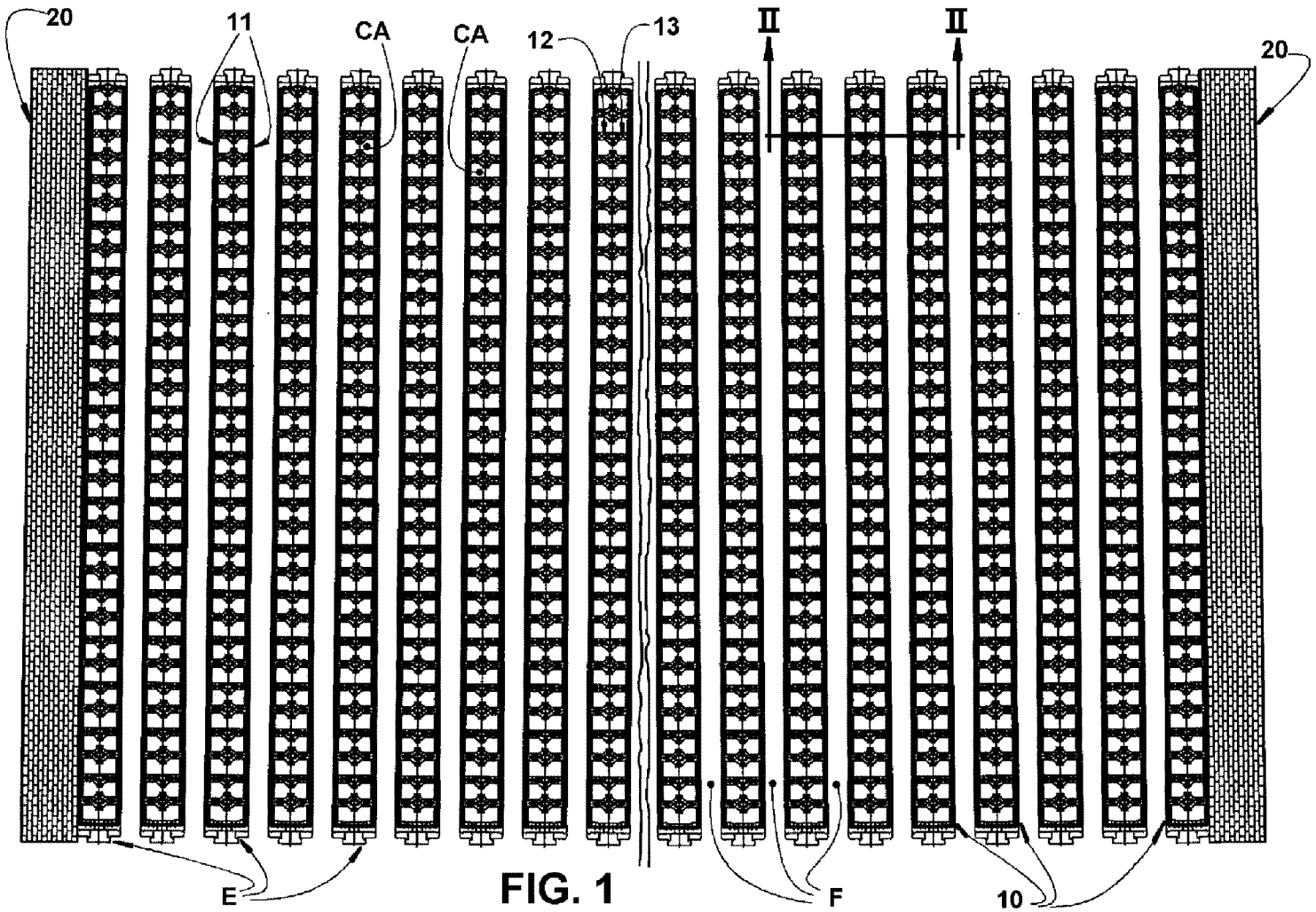
FIG. 1 is a simplified and somewhat schematic top plan view of a coke oven battery comprising a plurality of ovens arranged side by side between two thermal insulation end walls of the battery.

As described above and illustrated in the drawing figures, the method is applied to ovens F for the production of coke that are arranged side by side in batteries and each comprising two sidewalls 10, opposite one another, and one of them is common to two adjacent ovens F. The sidewalls 10 are formed by side bricks 11 and transverse bricks 12 and 13, the latter being arranged in vertical columns, spaced apart from each other to define, within each sidewall 10, a plurality of heating chambers CA (or combustion chambers) arranged vertically and providing a hollow construction to each of said lateral sidewalls 10. The side bricks 11 and transverse bricks 12 and 13 are made of refractory material such as silica, fireclay, clinker or insulating material.

The opposing sidewalls 11 are seated on a generally concrete base (not shown), and are closed at the top by a top wall PT, in refractory bricks. Each oven F is closed at the top by a roof T, also made of refractory material and provided with loading ports (not shown) to allow charging of mineral coal to be processed into coke (see FIGS. 1, 2 and 3) in a constructive arrangement that is well known in the art.

Each heating chamber CA is internally and inferiorly provided with a ceramic burner Q that is sized to allow the combustion within each chamber to produce, within the two adjacent ovens F, the degree of heating required for the transformation of the mineral coal into coke.

Figure 2:
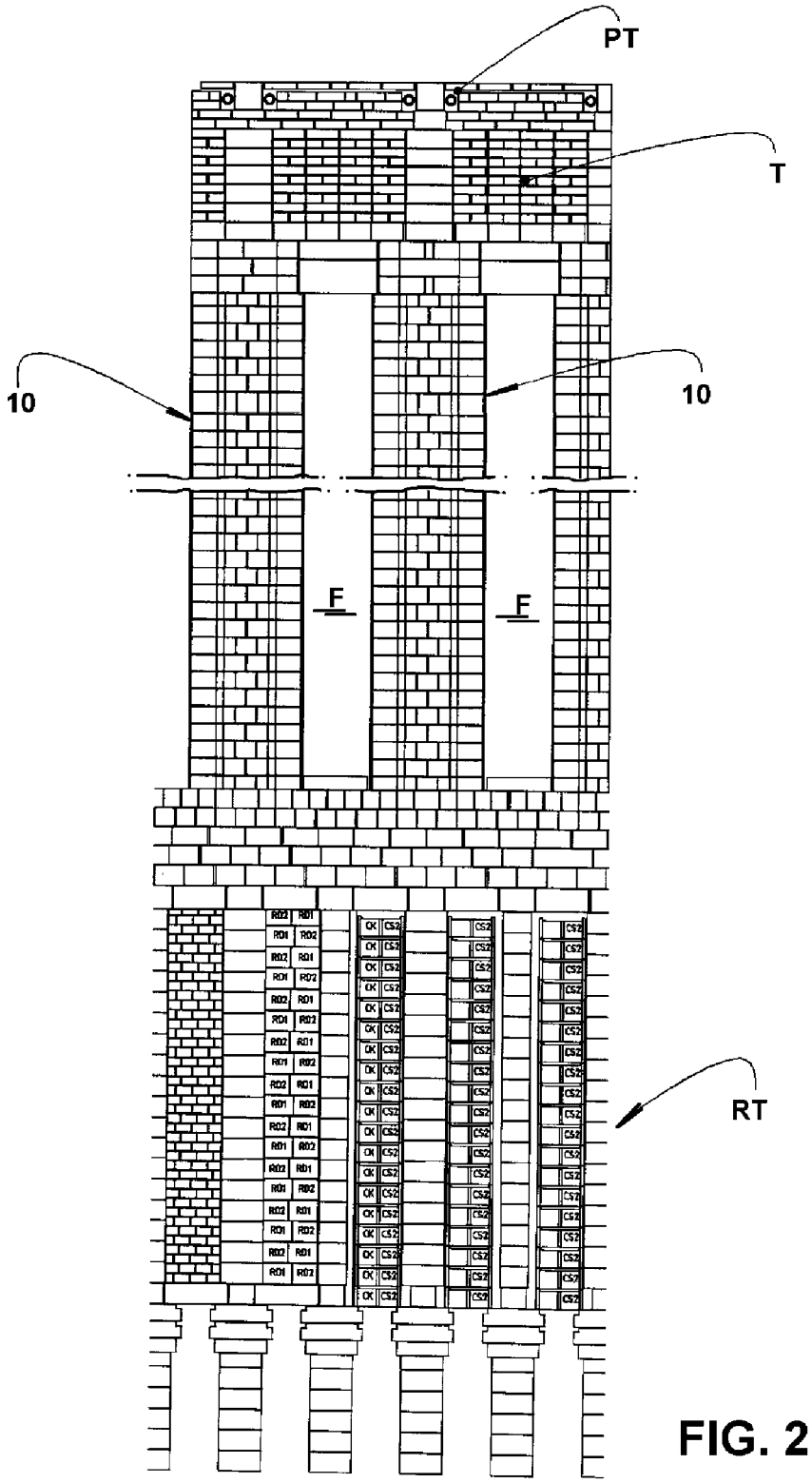
FIG. 2 is a partial cross-sectional view of the coke oven battery, the cut being taken along line II-II in FIG. 1.

As shown in FIG. 2, the oven battery is usually mounted on a respective set of thermal regenerators RT of known construction, to allow thermal reuse of the combustion gases expelled from the heating chambers CA.

Figure 3:
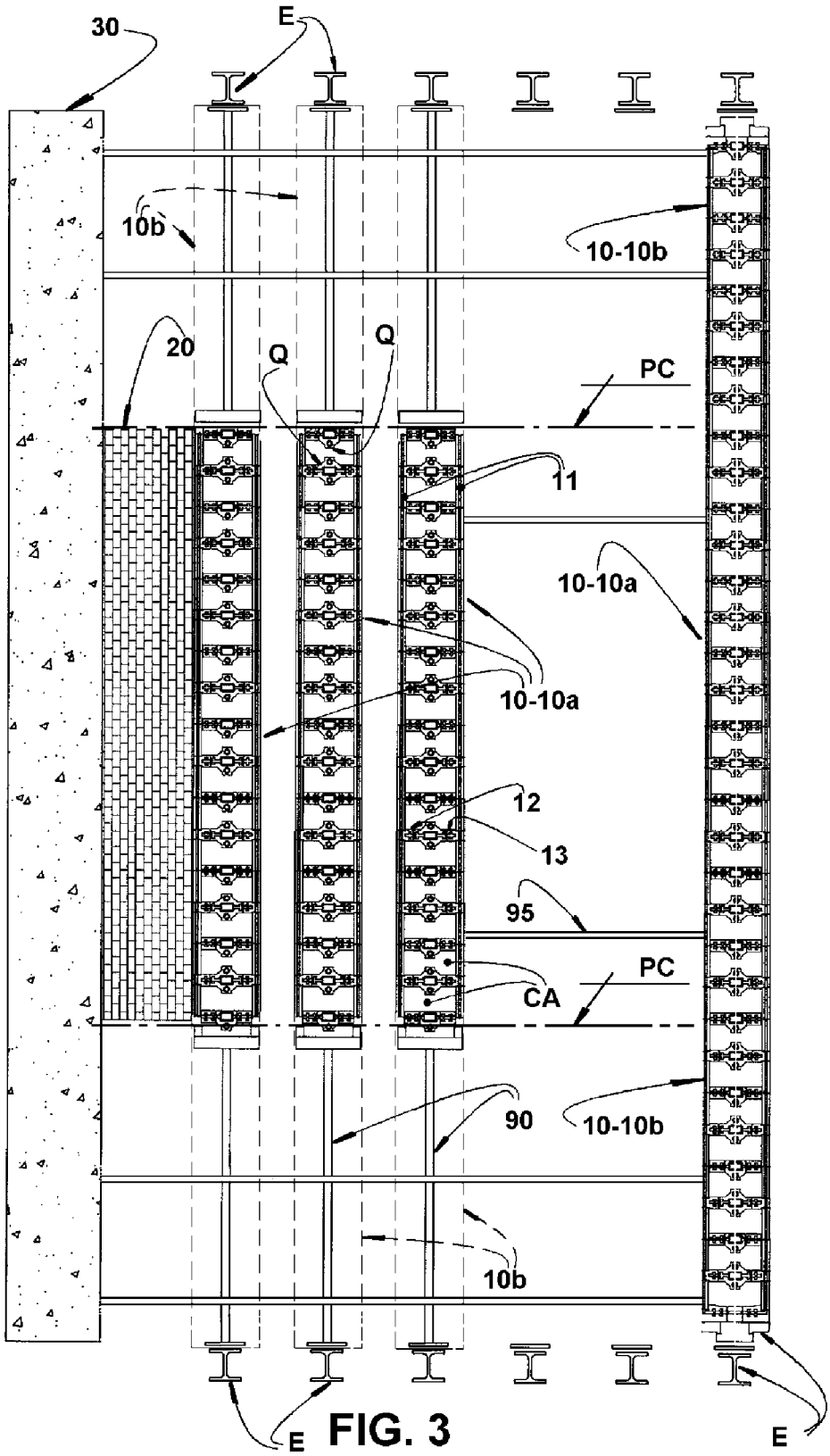
FIG. 3 is a similar view to that in FIG. 1, but only partially illustrating the oven battery with one of the thermal insulation end walls seated against a containment wall with three sidewalls defined only by their middle portions and having their opposite end portions already removed to be replaced by new end portions, and with two sidewalls totally removed for complete replacement by new walls.

As illustrated in FIGS. 1 and 3, the end sidewalls 10 of each oven battery F are laterally seated against insulating end walls 20, each of which being externally and laterally propped against a retaining wall 30 shown only in FIG. 3.

Also, as illustrated in FIGS. 1 and 3, the sidewalls 10 have their ends anchored by suitable front and rear structures E, which may be of any suitable construction and already incorporated in the prior art, thus not being part of the inventive aspects of this present method.

As already mentioned in the introduction to this application, partial and even total periodic replacement of the sidewalls 10 in ovens F of a battery is required.

FIG. 3 illustrates, in a simplified manner, the leftmost region of the battery of FIG. 1, with the first three sidewalls 10 represented only by their middle wall portions 10*a* due to the fact that their end wall portions 10*b* (see FIGS. 3 and 4) have been removed according to their degree of wear. Also shown in FIG. 3 is the complete removal of two sidewalls 10 adjacent to said middle portions 10*a* of the partially removed sidewalls 10.

Figure 4:
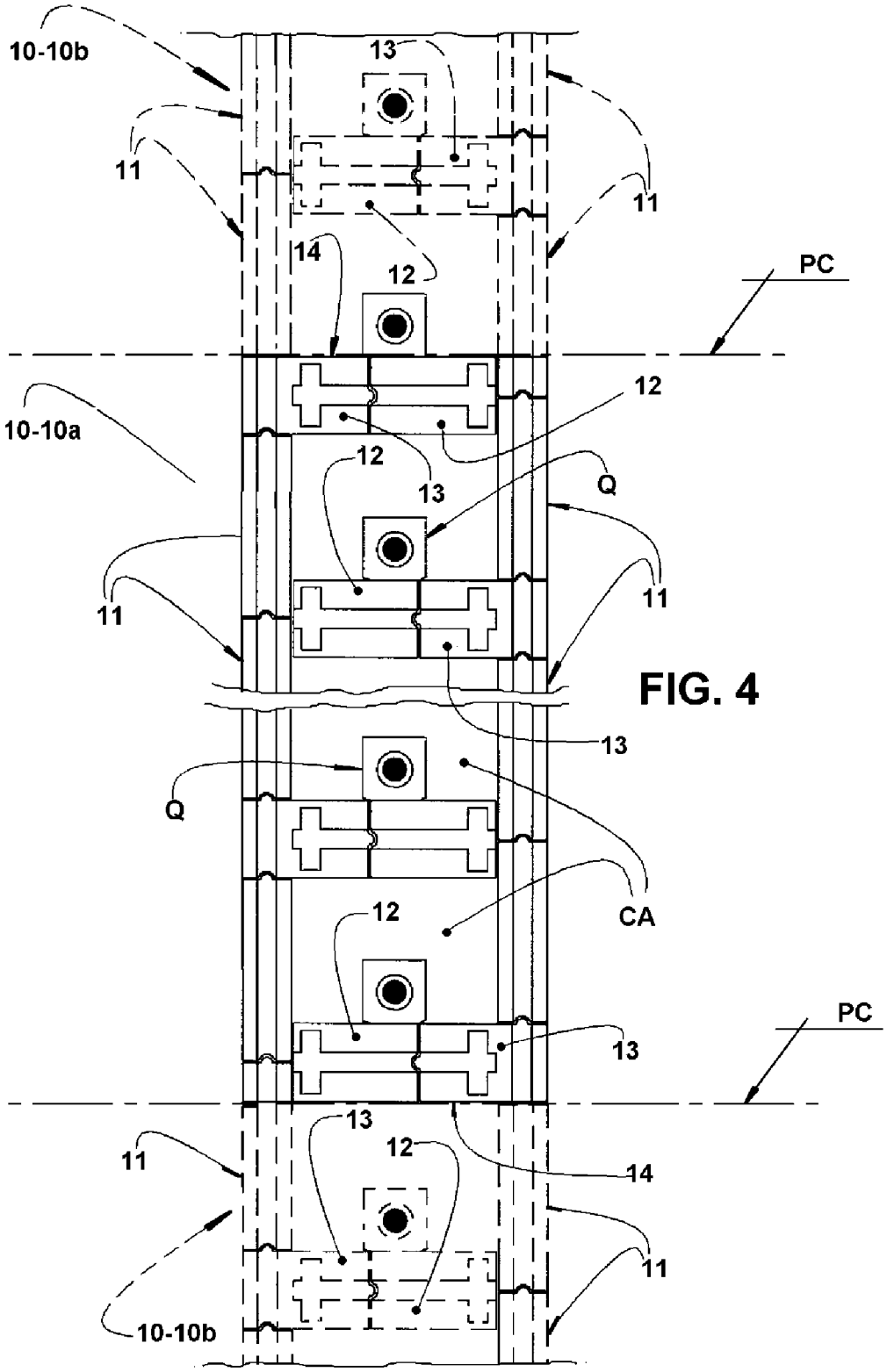
FIG. 4 is an enlarged and partially cut-away plan view of the middle portion of one of the sidewalls, illustrating not only the middle portion, but also, in dashed lines, part of the end portions to be removed, as well as the indication of the cutting plane for these walls.

FIG. 4 is an enlarged and partially cut away plan of a sidewall 10, showing in solid lines, the middle wall portion 10*a*, and in dashed lines showing the end wall portions 10*b* that will have their side bricks 11 and transverse bricks 12 and 13 replaced by new bricks.

Thus, the method in question begins with the step of selecting a group of adjacent sidewalls 10 that have a middle wall portion 10*a* to be maintained in the oven battery F and two end wall portions 10*b* to be replaced by new end wall portions.

According to the proposed method, the replacement of the end wall portions 10*b* is obtained through a step of cutting each sidewall 10 to be repaired, in a cross-sectional vertical cutting plane PC, in order to define a respective flat end face 14 in the middle wall portion 10*a*, each cutting plane PC coinciding with a face of a transverse row of bricks 12, 13, facing the adjacent end wall portion 10*b* that is being removed.

Figure 5:
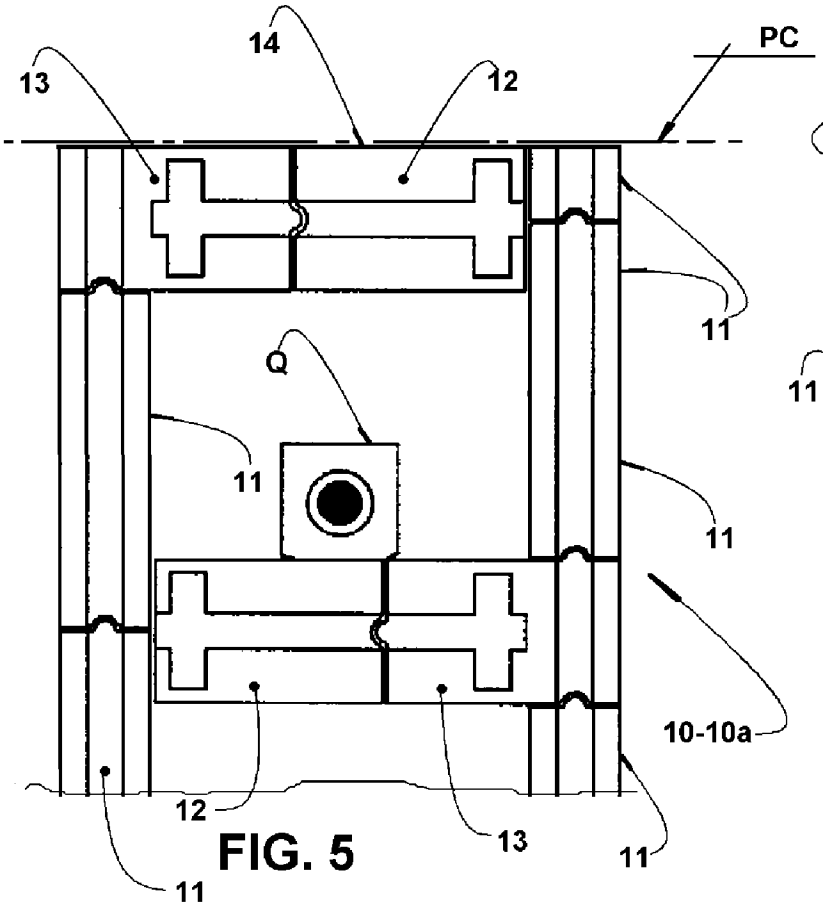
FIG. 5 is a similar view to that in FIG. 4 but showing only one of the cut ends of the middle wall portion.

With this cutting operation, each cutting plane PC intersects the tongue of the transverse bricks 13 which project to one of the outer faces of the sidewall 10, and also the side bricks 11 adjacent to the opposite outer face of the sidewall 10. These flat vertical cutting operations define, on each opposite end of the remaining middle wall portion 10*a*, a flat end face 14 shown in FIGS. 4 and 5 and devoid of surface accidents to provide mechanical locking between the new bricks in the end wall portion 10*b* and the old bricks in the middle wall portion 10*a*.

Due to the already mentioned difficulty to provide the adequate junction of said flat end faces 14 in the middle wall portion 10*a* with the new end wall portions 10*b*, by using complex and expensive ceramic welds, the method in question also comprises a step of providing in the region of each flat end face 14 in the middle wall portion 10*a*, a pair of cutouts 15 in opposite sides that cover the entire height of the sidewall 10. Each cut has generally straight dihedral walls with a basic transverse wall and a longitudinal wall that define the longitudinal depth of each cutout 15.

In order to guarantee solid locking between each new end wall portion 10*b* and the middle wall portion 10*a*, in each basic transverse face of each cutout 15, a middle longitudinal channel 15*c* is produced, which defines a groove for a corresponding tongue 11*c* of new bricks, larger side 11*b* and standard side 11*a* of the new end wall portion 10*b*.

The cutting operation can be performed, for example, with a manual cutting machine, in a sufficiently precise manner, but which provides a flat end wall 14 devoid of any tongue and groove.

Figure 6:
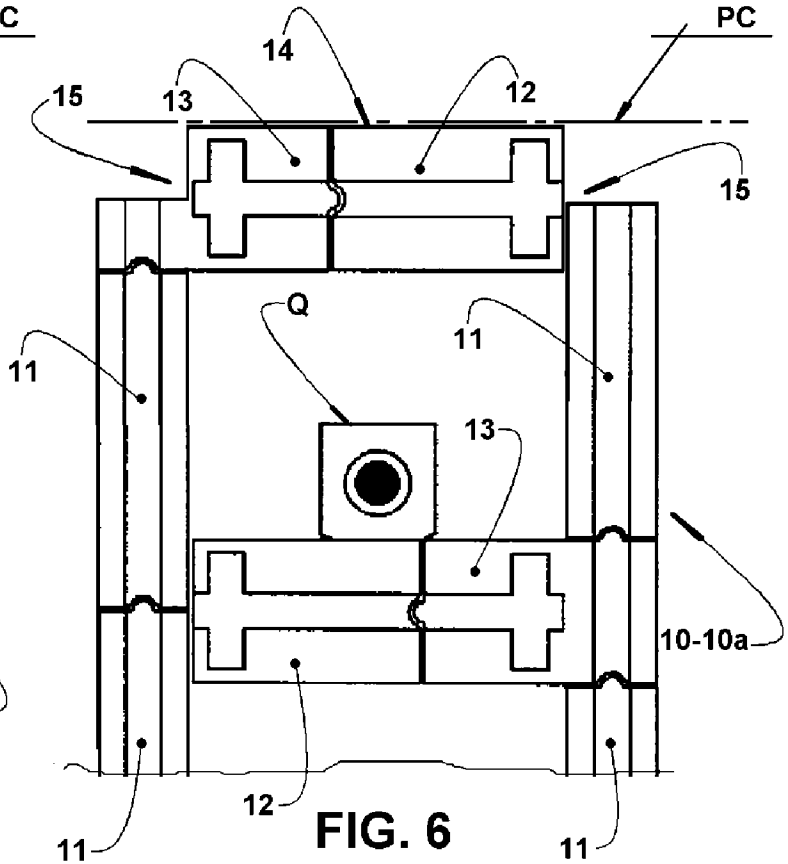
FIG. 6 is a similar view to that shown in FIG. 5, but illustrating a pair of opposite side cutouts, provided at one of the cut ends of the middle wall portion and extended over the full height of the respective middle wall portion.

Upon execution of the cutouts 15 in the flat end faces 14 of each middle wall portion 10*a*, a new step can be initiated, comprising the fitting of a portion corresponding to a vertical row of side bricks 11 in a new adjacent end wall portion 10*b*. These side bricks comprise, alternately along the vertical row, a new standard side brick of equal length to that of the side bricks 11 of the middle wall portion 10*a*, and a new larger side brick 11*b*, having a length equal to the sum of the length X of the other side bricks 11 of each sidewall 10 with the longitudinal depth y of the cutouts 15, as shown in FIG. 6.

The provision of the new larger side brick 11*b* results from the fact that each cutout 15 is transversely aligned with another cutout 15 in the same flat end wall 14, thus requiring one of the new side bricks, herein called 'larger brick' 11*b*, to present a greater length than the standard length of bricks 11 in the middle wall portion 10*a*, which is the same as other standard bricks 11*a* in the new end wall portion 10*b*, so that the same arrangement of bricks in "rows" can be maintained.

The new transverse bricks 12*a* and 13*a* have the same standard construction as the transverse bricks 12 and 13 in the sidewall 10 that is being restored.

The fitting of the tongue 11*c* of the new bricks, larger side 11*b* and standard side 11*a*, into the middle longitudinal channel 15*c* of the basic transverse face in each cutout 15 allows the fit between the old bricks and new bricks to withstand the transversal expanding forces of the coal under treatment.

The junction regions of the new side bricks 11*a* and 11*b* and of the new transverse bricks 12*a* and 13*a*, with each other and with the old side bricks 11, only receive the appropriate amount of refractory mass to ensure the desired sealing of the joints, making it unnecessary to execute any ceramic welding.

This assembly provides a robust transverse mechanical locking between the middle wall portion 10*a* and the new end wall portions 10*b*, preventing relative displacement between said middle wall portions 10*a* and end walls 10*b*, in an direction orthogonal to their common assembly plane during normal operation of ovens F.

Typically, the sidewalls 10 are disposed on a lower portion of the ovens F constructed in known manner to define the aforementioned thermal regenerators RT. The method in question allows the walls of these thermal regenerators RT to also be restored concurrently with the repairs of the sidewalls 10 of ovens F, with the same benefits already mentioned regarding robustness with mechanical locking and sealing without formation of cracks and ensuring greater operational life between repairs.

Another innovative aspect of the solution proposed herein allows the significant increase on the number of sidewalls 10 to be simultaneously partially or completely restored. According to the oven battery F construction type considered here, the loading machine (not shown) travels over the battery, supported on rails 40 which are transversally supported on the sidewalls 10 of the ovens F throughout the extension of the oven battery (see FIG. 3).

Due to the weight of the loading machine, particularly when loaded, the span of the rails 40 devoid of the support from the sidewalls 10 should normally not exceed four sidewalls 10, i.e. it does not allow the simultaneous restoration of more than three or four ovens F, which increases the cost of repair, requiring a greater number of operating interruptions for successive repairs of smaller scale.

Figure 8:
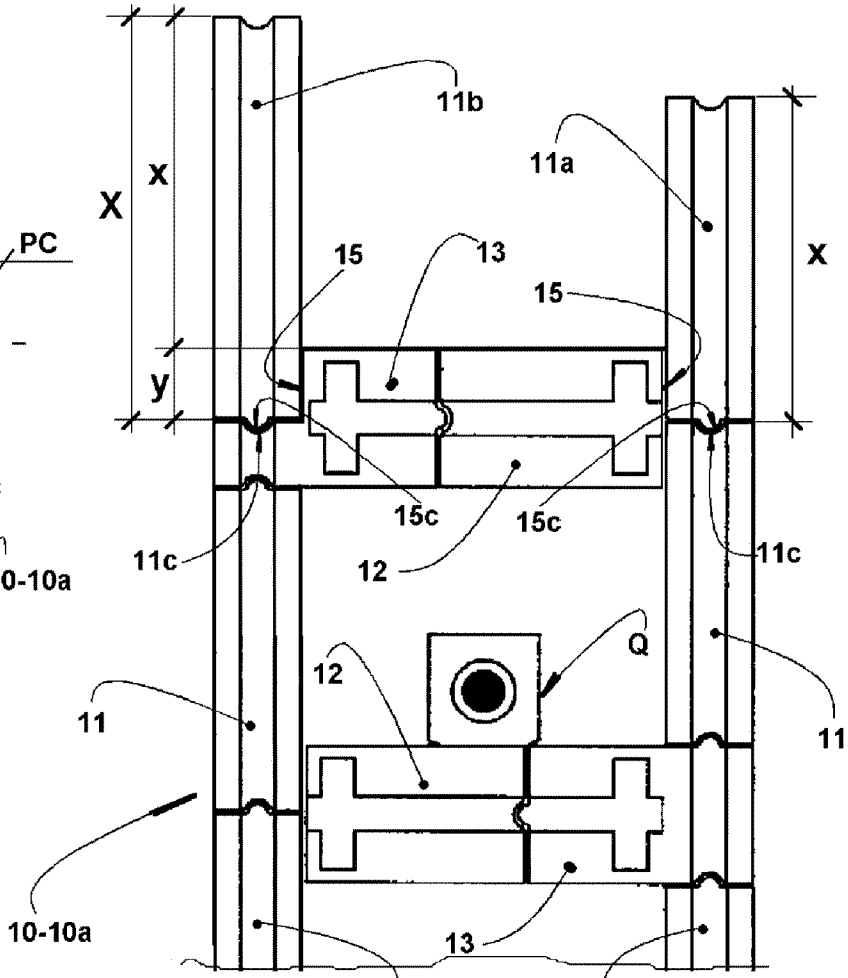
FIG. 8 is a similar view to that presented in FIG. 7, but illustrating the assembly of a new larger side brick and a new standard side brick, in their respective cutouts of the new end wall portion.
Figure 7:
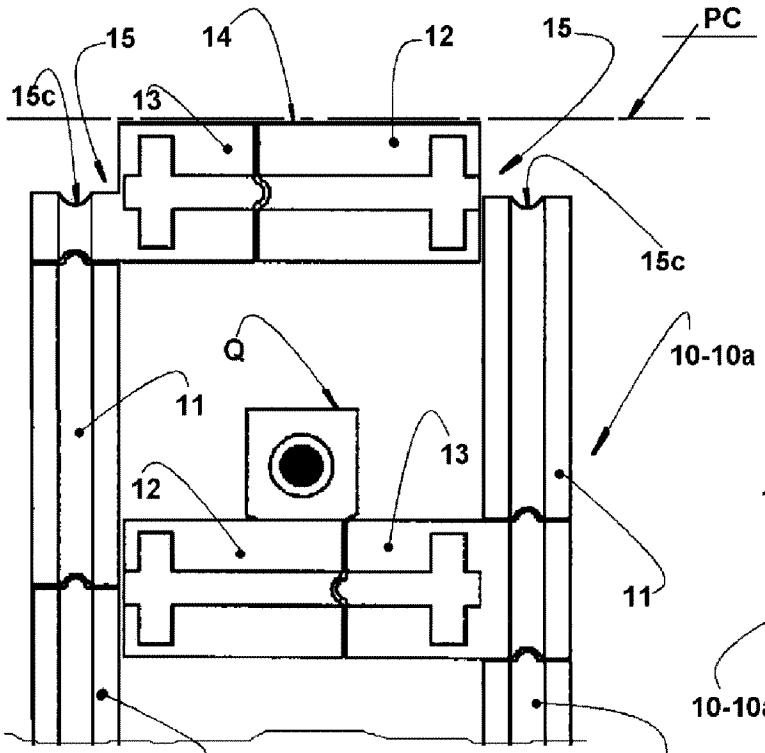
FIG. 7 is a similar view to that presented in FIG. 6, but showing a middle channel extended over the entire height of the basic transverse face of each cutout of the pair of the opposite side cutouts, in order to define a respective groove.
Figure 9:
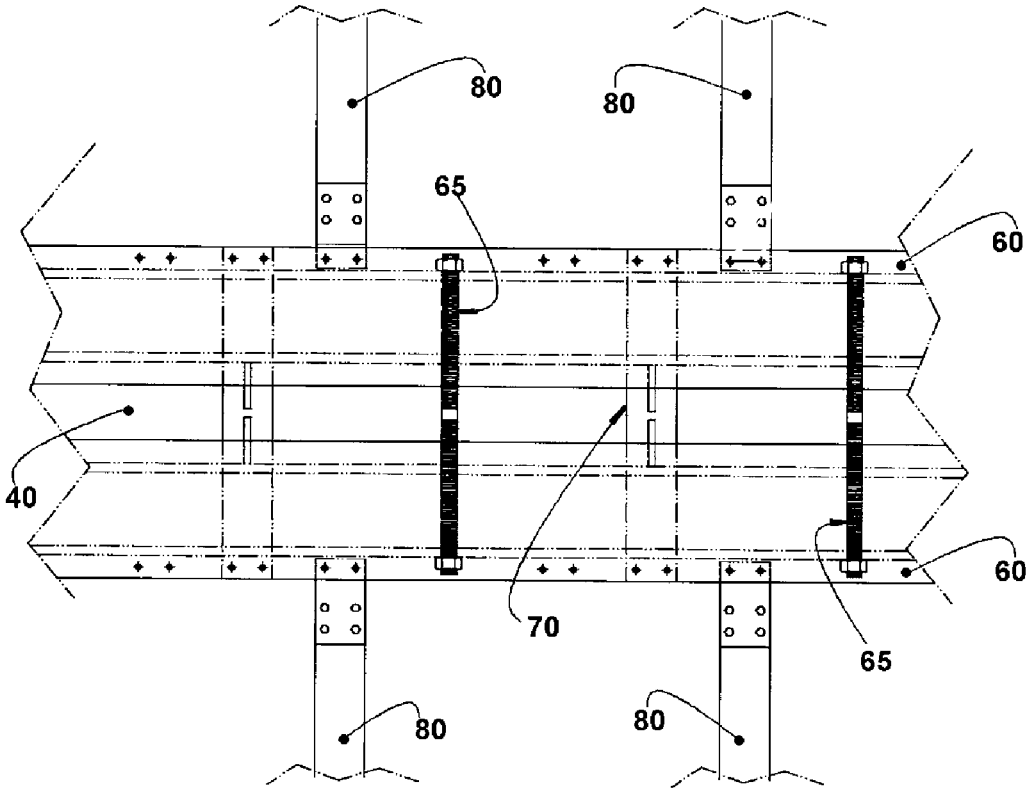
FIG. 9 is a plan view of a small extension of the reinforcing structure to support one of the rails of the loading machine.
Figure 10:
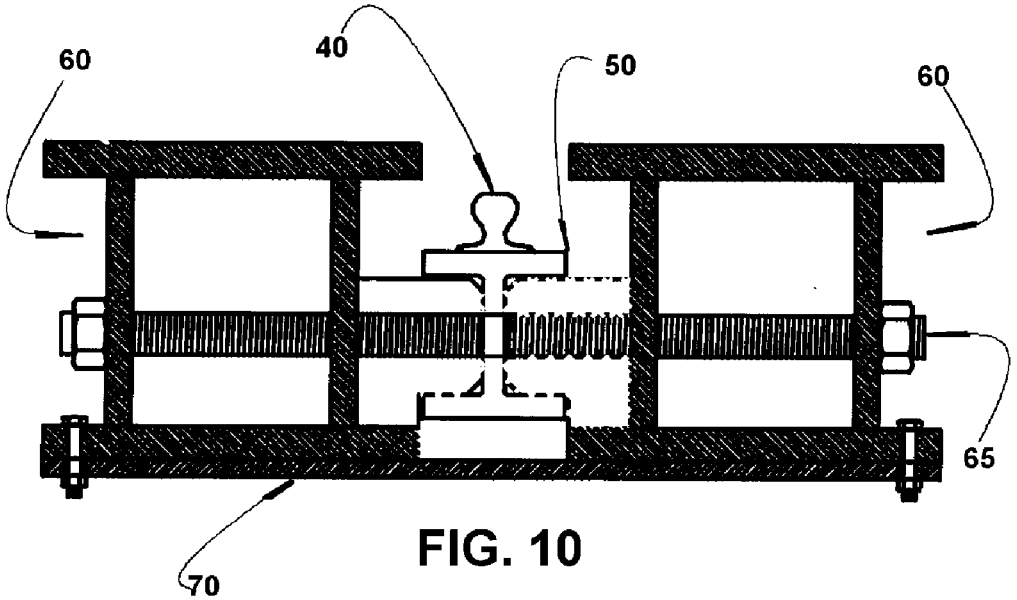
FIG. 10 represents a cross-sectional view of the frame portion shown in FIG. 8.

To reduce the costs of such partial and/or complete repair operations of the ovens F, the present invention also proposes the step of structurally reinforcing the rails 40 in the spans to be formed by the sidewalls 10 that were demolished for repair, as shown in FIGS. 3, 8 and 9.

Each rail 40 has its base longitudinally seated and fixed on a metal profile "I" 50 which is reinforced by a pair of beams 60, in the form of double "I" shaped metal profiles and welded side by side on the longitudinal ends of their top and lower flanges. The webs of the "I" profiles in the two beams 60 are crossed by a gripping stud 65 and the outer lower flanges of the two pairs of "I" profiles are fixed on the ends of a plurality of transversely arranged metallic base plates 70, spaced apart along the length of the beams 60, on whose middle portion the steel profile "I" 50 is seated and upon which rail 40 is supported.

The beams 60 are sized to fully cover the span to be formed by the partially or completely demolished walls, bearing on at least some of the walls near the span that will be covered by the rail.

In addition to the two beams 60 on each rail being fixed on the base plates 70, and thus also being lower and structurally interconnected, each two adjacent rails 40 are further structurally interconnected by means of metal sleepers 80 with their ends fixed on the external lower flanges of bordering beams 60, as partially illustrated in FIG. 8.

With the above arrangement, the load on the rails 40 is transferred to the gripping studs 65 and to the beams 60 in the region of the spans formed by the removal of walls or end wall portions, so that the beam ends 60 are supported on the remaining walls of the oven battery F, closer to the region of formation of the span. With this procedure, it becomes possible to safely cover spans of about 10 meters, i.e. spans resulting from the removal of about seven sidewalls 10, without prejudice to the continued operation of the loading machine on the battery of ovens F, regardless of whether the walls of each span being repaired have been partially or completely removed.

As schematically illustrated in FIG. 3, upon the removal of the end wall portions 10*b*, the flat end faces 14 of the middle wall portion 10*a* are held against the respective structures E on struts 90 made of metallic material and easily detachable. Similarly, the sidewalls 10 or sidewall portions 10*a* that define, due to the removal of the walls for repair, a gap corresponding to two or more walls, have their top region supported against confronting end regions of an opposite wall, by top struts 95 that are also metallic and detachable and may be in the form of profiles or frames.

The method in question presents the following advantageous aspects compared to those that have been used according to the state of the art:

a) The limitations of the previous method which does not allow the repair to be executed in mixed phases (partial and full repairs in the same batch) causes the need to perform the repair on a larger number of steps, significantly increasing the total repair time, resulting in greater loss of production and higher consumption of coke gas in order to keep the remaining areas on stand-by. The method in question uses a special insulation and shoring system that allows the correct and safe execution of a mixed batch (walls with partial and complete repair—FIG. 3)

b) The method in question allows to repair more adjacent walls (up to about 8 to 10), with reduced repair time and overall savings mentioned above.

c) The new method provides, for each type of repair, a solution to support the rails of the loading machine. Thus, it ensures the safe transit of the machine over the repair area, eliminating any effort that would inevitably be transmitted to the remaining stand-by areas of the lot to be repaired.

d) The bracing of the sidewalls of the battery adjacent to the lot being repaired guarantees perfect geometry and sealing of the other sidewalls of the battery which are kept in operation.

e) The recovery of the mechanical parts after the demolition of the refractory, bringing them back to their original topography. A spring system allows the control of the expansion of the new refractory, total or complete, during heating.

f) In case of partial repair, the new method considers the design and supply of the wall portion to be replaced. No adjustment of refractory parts is required in the field and all the "rows" of bricks are fitted as provided for in the design. The connecting part between the new part and the remainder is made with a specially shaped brick designed appropriately in the engineering phase. The cut in the old wall is complemented by the milling of a "groove" in the front of the remaining wall. In the set mentioned above (sliding joint) an aluminum foil is interposed, which facilitates the sliding of the new part in relation to the old part, when heating.

g) The new method does not require adjustments or interventions in the refractory wall after heating and the mechanical part is carried out in full compliance with the topographic adjustment made after the demolition of the refractory.

h) The new method uses bricks of special dimension to obtain the sliding joint, not requiring the application of any type of ceramic welding. The perfect sealing pressure and improved mechanical strength ensure that all the requirements of the repair are met.

i) The new method also provides for and allows the execution of repairs in the corresponding thermal regenerators RT, simultaneously with the repair of the heating sidewalls 10, with significant gains in terms of reduction in total execution time of the repair.

Besides the above mentioned advantages, it should be noted that the new method is effective with regard to the ease of repair execution, to the elimination of the need for adjustments in the field and to the provision of a perfect pressure seal, with high mechanical strength without requiring periodic maintenance and ceramic welding in the connection between the new bricks and old bricks (sliding joint).

The improvements resulting from the new method described above enable an overall reduction of repair costs due to the substantial reduction in execution time and consequent optimization of labor, among other factors mentioned, such as not needing the application of ceramic welding.

The invention claimed is:

1. Method for the repair of coke ovens arranged side by side in a battery which are each delimited by two hollow sidewalls, each formed by side bricks, superimposed in two opposed and spaced rows and spaced together by transverse bricks and defining, between them, heating chambers, wherein the method comprises the following steps:

selecting a group of adjacent sidewalls and having a middle wall portion to be kept throughout the repair and two end wall portions to be replaced by new end wall portions;

cutting each sidewall to be repaired in accordance with a cross-sectional vertical cutting plane in order to define a respective flat end face in the middle wall portion, said cutting plane being coincident with a face of a transverse row of bricks facing the adjacent end wall portion being removed;

providing, in the region of each flat end face of the middle wall portion, a pair of side and opposing cutouts and extending over the entire height of the sidewall;

producing, at a basic transverse face of each cutout, a middle longitudinal channel defining a groove for a corresponding tongue of the new bricks, the larger side and standard side of the new end wall portion;

fitting, in each cutout of a flat end face, the corresponding portion of a vertical row of side bricks of a new adjacent portion of the end wall, and the said side bricks comprise, alternately along the vertical row, a new standard side brick of a length equal to the side bricks of the middle wall portion, and a new larger side brick; and completing the formation of the new end wall portion using new transverse bricks.

2. Method according to claim 1, wherein the new standard side brick has a length equal to that of the side bricks in the middle wall portion, the new larger side brick having a length equal to the sum of the length of the other side bricks in each sidewall with the axial depth of the cutouts.

3. Method according to claim 1, wherein the new transverse bricks have the same standard construction of the transverse bricks in the sidewall being restored.

4. Method according to claim 1, wherein the formation of new end wall portion is carried out by applying, at the junction regions of the new standard side bricks and larger side bricks and the new transverse bricks, between themselves and with the old side bricks, an appropriate amount of refractory mass to ensure the desired sealing at the joints.

5. Method according to claim 1, wherein the oven battery supports rails for the displacement of a loading machine and which are transversely supported on the sidewalls of the ovens along the entire length of the oven battery, wherein the method further includes, between the step of selecting the group of adjacent sidewalls to be repaired and the step of cutting each sidewall to be repaired, the step of structurally reinforcing the rails in the gaps to be formed by the sidewalls that are dismantled for repair by means of a pair of beams, each fixed along one side of each rail, these beams being dimensioned to cover the entire gap being formed by the partially or completely demolished walls, relying on at least some of the walls closest to the gap to be covered by rail.

6. Method according to claim 5, wherein each rail has its base longitudinally seated and fixed on a metal "I" profile which is reinforced by the respective pair of beams; and the webs of the two beams and the metal "I" metal profile being crossed by a clamping stud.

7. Method according to claim 5, wherein each beam comprises two "I" shaped metal profiles welded side by side by the longitudinal edges of their upper and lower flanges, and the outer lower flanges of the two pairs of "I" shaped profiles are fixed on the ends of a plurality of metal and transversely disposed base plates spaced apart along the length of the beams and on the middle portion of which the metal profile "I" is seated on which the respective rail is supported.

8. Method according to claim 7, wherein each two adjacent rails are further structurally interconnected by means of metallic sleepers with their ends fixed on the outer lower flanges in the bordering beams.

9. Method according to claim 1, further including, after the step of cutting each sidewall to be repaired, and the removal of the end wall portion to be replaced, the provision of: a plurality of metal and detachable struts, each having a flat end face of the middle wall portion supported by front or rear structures of the oven battery; and metal and detachable top struts, arranged between confronting top regions of opposite oven walls of a gap defined by the partial or complete removal of walls to be repaired.

* * * * *